US007721653B1

(12) United States Patent
Burgess

(10) Patent No.: US 7,721,653 B1
(45) Date of Patent: May 25, 2010

(54) COMBINED SUBWAY WALL AND DOOR ASSEMBLY AND ASSOCIATED METHOD

(76) Inventor: Lamass Burgess, 62 Warner Ave., Jersey City, NJ (US) 07305

( * ) Notice: Subject to any disclaimer, the term of this patent is extended or adjusted under 35 U.S.C. 154(b) by 221 days.

(21) Appl. No.: 11/985,881

(22) Filed: Nov. 19, 2007

(51) Int. Cl.
*B61B 1/00* (2006.01)
*B61B 1/02* (2006.01)

(52) U.S. Cl. ..... 104/28; 104/27; 104/30

(58) Field of Classification Search ..... 104/27, 104/28, 30
See application file for complete search history.

(56) References Cited

U.S. PATENT DOCUMENTS 5,295,441 A * 3/1994 Kawanishi et al. ..... 104/28
5,832,836 A * 11/1998 Ehrlich et al. ..... 105/4.3
6,105,905 A * 8/2000 Spence ..... 246/127
6,360,668 B1 * 3/2002 Rauch ..... 104/30
7,328,662 B2 * 2/2008 Kasai et al. ..... 105/429
2009/0145325 A1 * 6/2009 Bradley et al. ..... 104/28
2009/0165665 A1 * 7/2009 Gunes ..... 104/30

* cited by examiner

*Primary Examiner*—S. Joseph Morano
*Assistant Examiner*—Zachary Kuhfuss

(57) ABSTRACT

A combined wall and door assembly includes a static wall assembly including a segmented support frame with a rectilinear shape. The static wall assembly further includes a plurality of transparent fiberglass panels directly coupled to the support frame and spaced along an entire longitudinal length of the support frame. The assembly further includes a mechanism for automatically biasing the access doors between open and closed positions when the subway train arrives and leaves a train terminal respectively such that passengers are prohibited from premature ingress and egress of the subway train during a schedule stop.

9 Claims, 7 Drawing Sheets

COMBINED SUBWAY WALL AND DOOR ASSEMBLY AND ASSOCIATED METHOD

CROSS REFERENCE TO RELATED APPLICATIONS

This application claims the benefit of U.S. Provisional Application No. 60/850,821, filed Oct. 12, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to subway door assemblies and, more particularly, to a combined subway wall and door assembly for providing a safe passageway to ingress and egress a subway train from an adjacent platform.

2. Prior Art

The first subway, which began operating in 1863 in London, England, used steam locomotives. The subway was successful and it expanded, converting to electricity in about 1896. The first electric subway line in the United States opened in Boston, Mass., in 1897 to immediate success. New York City followed in 1904 with approximately nine miles of subway track. New York's subway system, is now one of the world's largest, covering hundreds of miles. Subways primarily serve highly populated metropolitan areas. Because of this core of passengers, subways have not been as challenged as other forms of mass transit to maintain their rider base during the past half-century. In addition, such systems are comparatively environmentally-sound and inexpensive to operate and their use helps mitigate traffic congestion. Although subways provide millions of individuals with an affordable and efficient way to commute, subways are inherently dangerous and many individuals are injured or killed each year. Most accidents result from individuals accidentally falling or intentionally jumping onto the rails, ahead of an oncoming subway. Although a few individuals survive, death is invariably the result of jumping in front of a fast-moving subway train, hurtling into the subway station at nearly 40 mph. Based on the above mentioned needs, it would be advantageous to provide a means for increasing public safety on subway platforms.

U.S. Pat. No. 6,926,462 to Fuganti discloses a safety barrier for road use that comprises a barrier element which can be displaced between an operative position, above the road surface, and an inoperative position, in which it does not substantially project above the road surface. Preferably provided is a number of sets of aligned barrier elements, rigidly connected to one another, the adjacent sets being connected together by articulated connecting structures which enable one set of barrier elements to be displaced between its inoperative position and its operative position without modifying the positions of the adjacent sets. In this way, one or more stretches of the barrier can be brought into the inoperative condition, leaving the adjacent stretches of barrier in the normal operative condition. Unfortunately, this prior art example does not prevent the specific dangers associated with subway platforms.

U.S. Pat. No. 6,056,038 to Foster discloses a safety barrier comprising a support, a partition frame hingedly connected to the support, and a retractable membrane attached to one end of the partition frame. The partition frame and the support can be extended across an opening, such as a doorway, to securely position the barrier within the opening. The partition frame includes a first member hingedly connected to the support and a second member slidingly engaged to the first member. The retractable member may be deployed toward an opposite end of the partition frame to close off the opening. Unfortunately, this prior art example does not automatically biased to an open position when it becomes appropriate for a user to enter the blocked opening.

U.S. Pat. No. 5,649,396 to Carr discloses a semaphore type loading dock safety barrier for use across a vehicle passageway to prevent accidentally driving a vehicle off the end of the loading dock. A barrier mount is attached to a guidepost inside the loading dock doorway and is horizontally rotatable about a vertical axis. A rigid barrier arm is rotatably affixed to the barrier mount so that the barrier arm raises and lowers vertically in a semaphore arm fashion. The barrier arm is typically constructed from an I-beam or box beam and is of sufficient strength to resist vehicle impact. A receiving rest is attached to an opposite guidepost inside the loading dock doorway and is horizontally rotatable about a vertical axis and positioned to receive the free end of the barrier arm. The receiving rest has locking means on the receiving rest to lock the free end of the barrier arm in the receiving rest so that upon vehicle impact with the barrier arm deformation of the barrier arm and rotation of the barrier mount and receiving rest about their respective vertical rotation axes occurs while retaining the barrier arm in a locked relationship with the receiving rest. Unfortunately, this prior art example does not prevent the specific dangers associated with subway platforms.

Accordingly, the present invention is disclosed in order to overcome the above noted shortcomings. The present invention is convenient and easy to use, durable in design, and designed for providing a safe passageway to ingress and egress a subway train from an adjacent platform. The present invention is simple to use and designed for many years of repeated use.

BRIEF SUMMARY OF THE INVENTION

In view of the foregoing background, it is therefore an object of the present invention to provide an apparatus for providing a safe passageway to ingress and egress a subway train from an adjacent platform. These and other objects, features, and advantages of the invention are provided by a combined subway wall and door assembly.

A combined wall and door assembly includes a static wall assembly including a segmented support frame with a rectilinear shape. Such a support frame includes a first plurality of horizontally disposed support members situated along segmented end-to-end longitudinal relationships along a ground surface of the subway platform. A plurality of vertically disposed support members are equidistantly spaced between adjacent ones of the first plurality of support members and directly connected thereto respectively and a second plurality of horizontally disposed support members are effectively situated along the segmented end-to-end longitudinal relationship above the ground surface of the subway platform. Such a second plurality of support members are directly connected to top ends of the vertically disposed support members.

The static wall assembly further includes a plurality of transparent fiberglass panels directly coupled to the support frame and spaced along an entire longitudinal length of the support frame. A plurality of door assemblies conveniently includes a plurality of raised access ports statically affixed to selected areas of the support frame, and a plurality of horizontally slidable access doors operably engaged with the access ports and positioned generally between the segmented support frame.

The assembly further includes a mechanism for automatically biasing the access doors between open and closed positions when the subway train arrives and leaves a train terminal respectively such that passengers are prohibited from premature ingress and egress of the subway train during a schedule stop. Such an automatic biasing mechanism includes a plurality of sensors positioned at selected portions of the wall assembly. Each of such sensors advantageously generates and transmits an input signal when the subway train reaches the terminal. Each of such input signals has a true value when the access doors are aligned with the subway train, and each of the input signals have a false value when the access doors are not aligned with the subway train.

The automatic biasing mechanism further includes a logic gate directly coupled to the sensors and receiving the input signals. Such a logic gate effectively generates and transmits a true output signal when all of the input signals have the true values respectively, and the logic gate generates and transmits a false output signal when at least one of the input signals have a false value. At least one light array is electrically coupled directly to the access ports.

The automatic biasing mechanism further includes a control switch electrically coupled to the logic gate and responsive to the output signal. Such a control switch generates and transmits first and second control signals for toggling the light-emitting members between first and second colors when the logic gate output signal is true and false respectively. The control signal further generates and transmits a third control signal upon receipt of the true output signal from the logic gate. An actuator assembly is operably coupled directly to the control switch and the access ports respectively. Such an actuator assembly conveniently causes the access doors to slidably adapt between the open and closed positions when the control switch generates and transmits the third control signal.

The actuator assembly includes a single and unitary bracket extending upwardly from the first plurality of support members up to a termination point located above the second plurality of support members respectively. A plurality of guide tracks is directly anchored to respective top portions of the brackets and is registered parallel to the first and second pluralities of support members respectively. A plurality of casters is rotatably connected to the guide tracks and extends downwardly therefrom such that the casters become directly abutted against top edges of the access doors respectively. Such casters advantageously rotate along clockwise and counter clockwise directions when the control switch transmits the third control signal and thereby cause the access doors to linearly travel along lateral and medial directions within respect to the brackets respectively.

The support frame effectively remains stationary while the access doors are biased between the open and closed positions, and lateral and medial top corners of the access doors are engaged with the casters when the access doors are situated at the closed and open positions respectively.

A method for utilizing a combined wall and door assembly to provide a safe ingress and egress passageway for a subway train from an adjacent platform includes the steps of: providing a static wall assembly by providing a segmented support frame has a rectilinear shape, and directly coupling a plurality of transparent fiberglass panels to the support frame by spacing the fiberglass panels along an entire longitudinal length of the support frame; providing a plurality of door assemblies by statically affixing a plurality of raised access ports to selected areas of the support frame, and operably engaging a plurality of horizontally slidable access doors with the access ports by positioning the access doors generally between the segmented support frame; and automatically biasing the access doors between open and closed positions when the subway train arrives and leaves a train terminal respectively such that passengers are prohibited from premature ingress and egress of the subway train during a schedule stop.

The method further includes the steps of: positioning a plurality of sensors at selected portions of the wall assembly; directly coupling a logic gate to the sensors; electrically coupling at least one light array directly to the access ports; electrically coupling a control switch to the logic gate; operably coupling an actuator assembly directly to the control switch and the access ports respectively; each of the sensors generating and transmitting an input signal when the subway train reaches the terminal; each of the input signals has a true value when the access doors are aligned with the subway train; each of the input signals have a false value when the access doors are not aligned with the subway train; the logic gate receiving the input signals and generating and transmitting a true output signal when all of the input signals have the true values respectively; the logic gate generating and transmitting a false output signal when at least one of the input signals have a false value; the control switch is responsive to the output signal and generating and transmitting first and second control signals for toggling the light-emitting members between first and second colors when the logic gate output signal is true and false respectively; the control signal further generating and transmitting a third control signal upon receipt of the true output signal from the logic gate; and the actuator assembly causing the access doors to slidably adapt between the open and closed positions when the control switch generates and transmits the third control signal.

The method further includes the steps of: situating a first plurality of horizontally disposed support members along segmented end-to-end longitudinal relationships along a ground surface of the subway platform; equidistantly spacing a plurality of vertically disposed support members between adjacent ones of the first plurality of support members by directly connecting the vertically disposed support members thereto respectively; situating a second plurality of horizontally disposed support members along a segmented end-to-end longitudinal relationship above the ground surface of the subway platform; and directly connected the second plurality of support members is to top ends of the vertically disposed support members.

The method further includes the steps of: extending a single and unitary bracket upwardly from the first plurality of support members up to a termination point located above the second plurality of support members respectively; directly anchoring a plurality of guide tracks to respective top portions of the brackets by registering the guide tracks parallel to the first and second pluralities of support members respectively; rotatably connecting a plurality of casters to the guide tracks by extending the casters downwardly therefrom such that the casters and directly abut top edges of the access doors respectively; and the casters rotating along clockwise and counter clockwise directions when the control switch transmits the third control signal and thereby cause the access doors to linearly travel along lateral and medial directions within respect to the brackets respectively.

The method further includes the steps of: maintaining the support frame stationary while the access doors are biased between the open and closed positions; and engaging lateral and medial top corners of the access doors with the casters when the access doors are situated at the closed and open positions respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
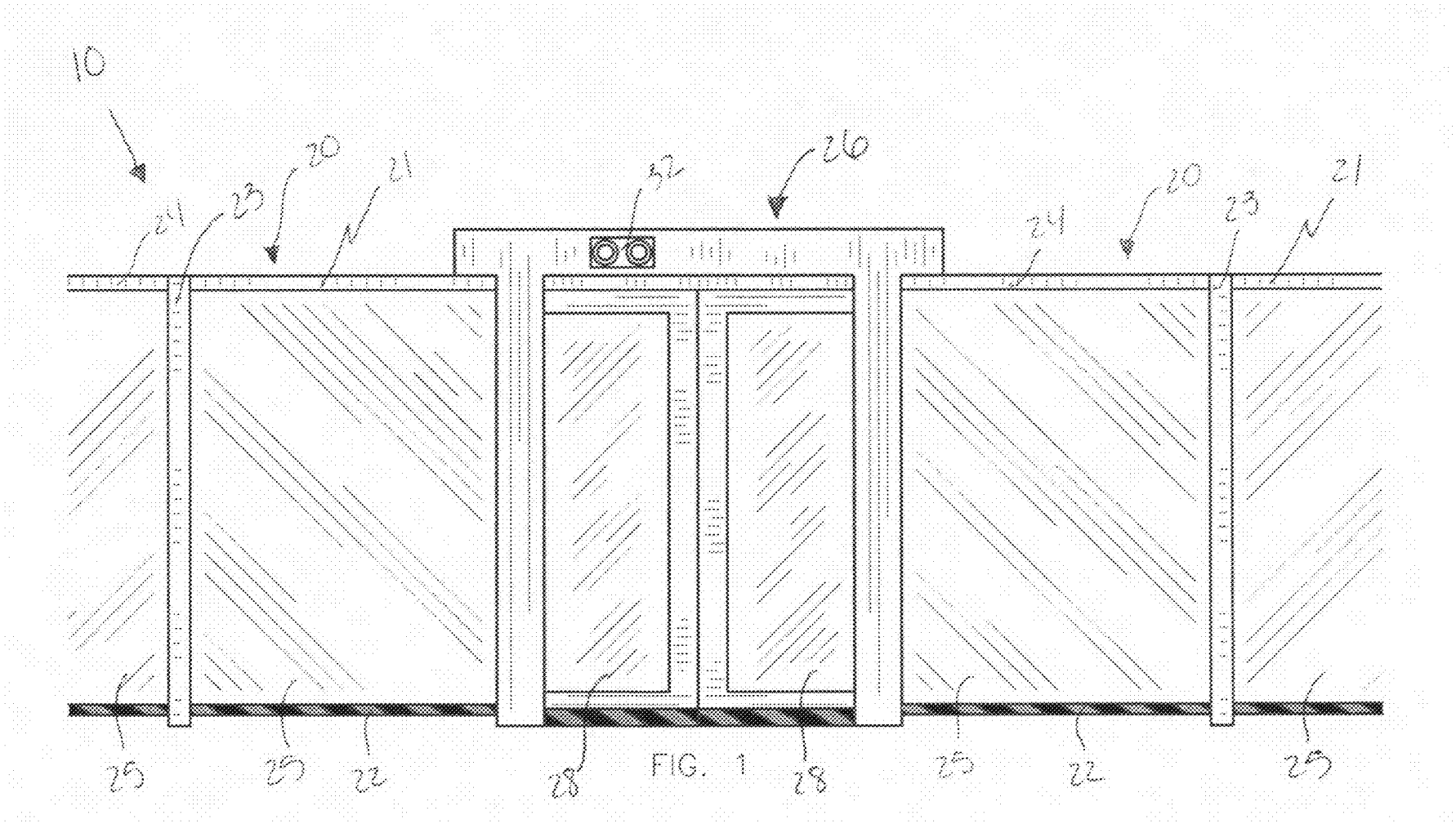
FIG. 1 is a front elevational view of a combined subway wall and door assembly with the access doors in a closed position, in accordance with the present invention.
Figure 2:
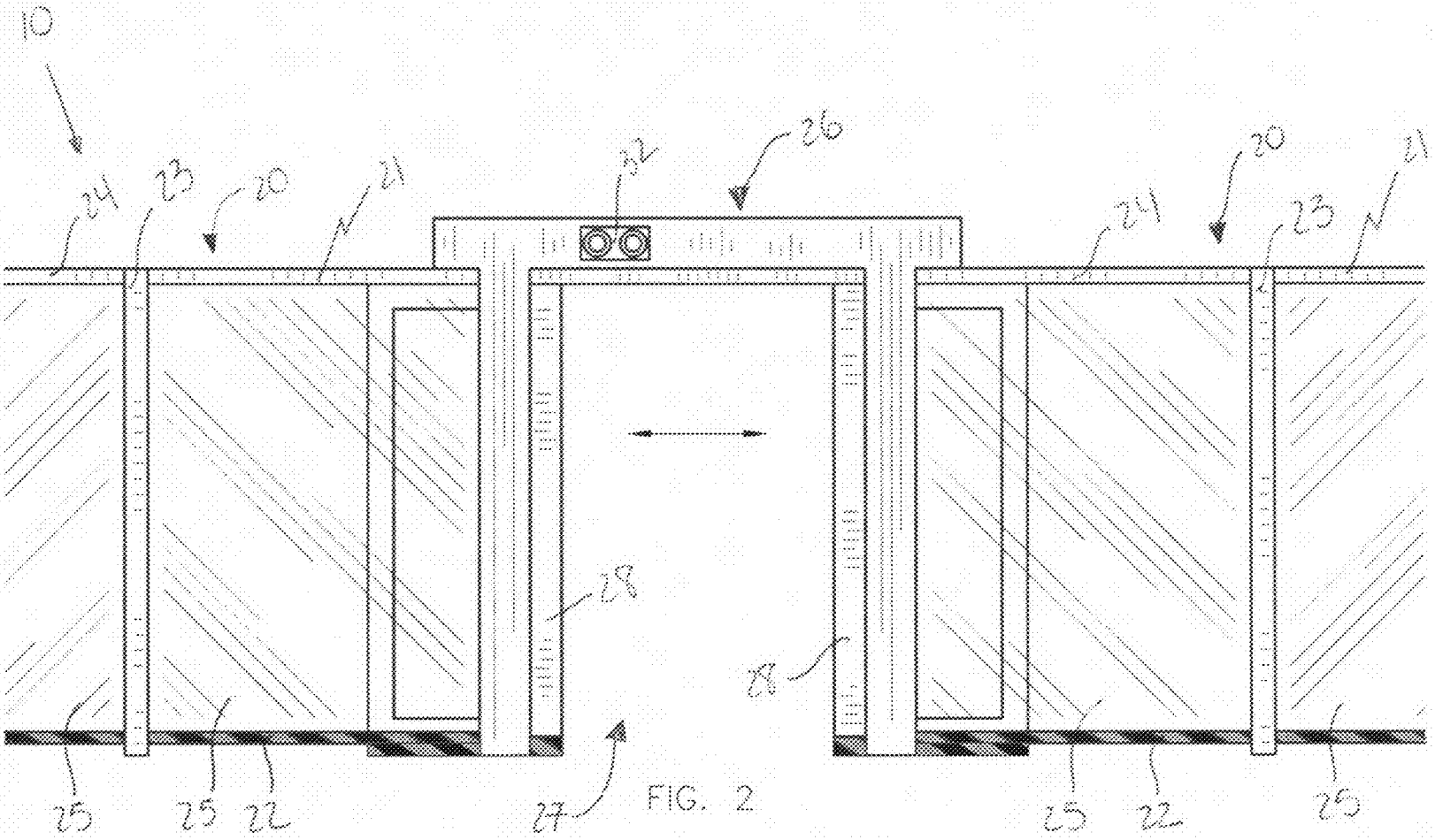
FIG. 2 is a front elevational view of a combined subway wall and door assembly with the access doors in an opened position, in accordance with the present invention.
Figure 3:
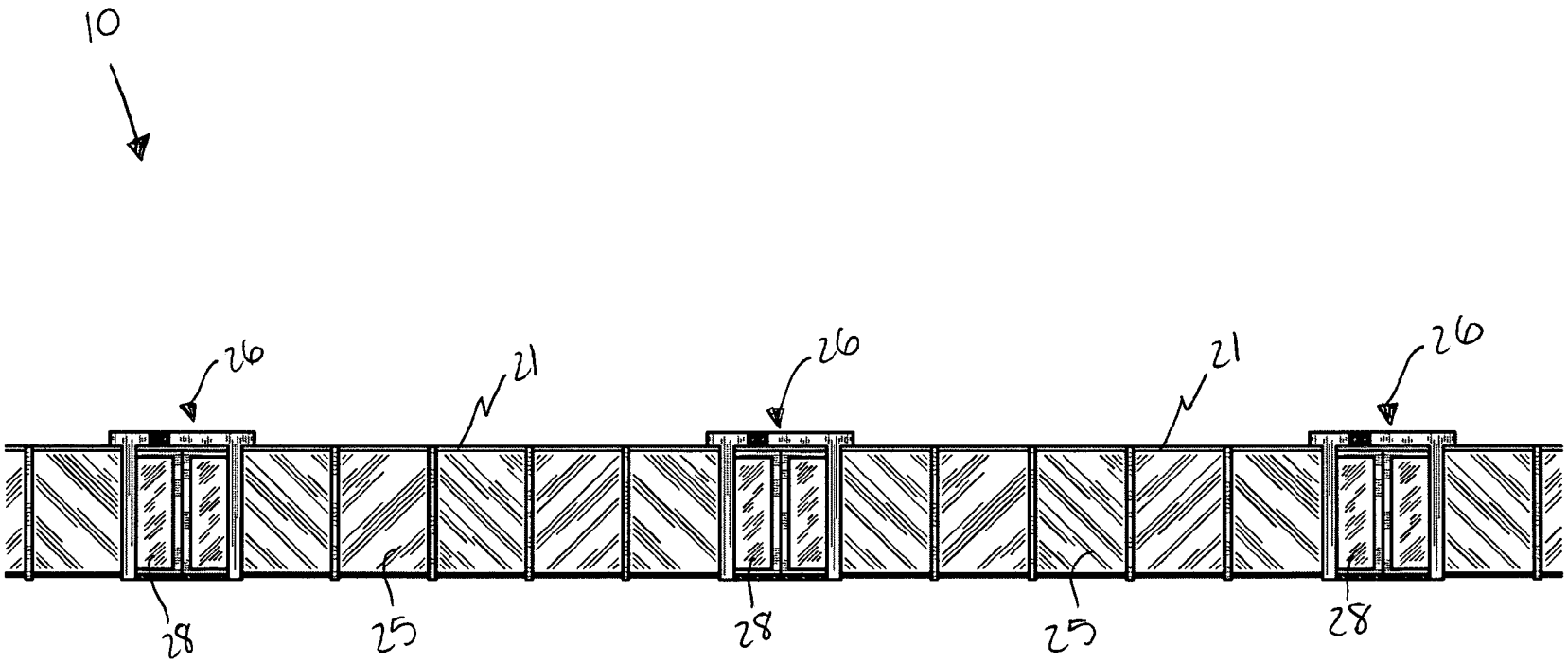
FIG. 3 is a panoramic view of a combined subway wall and door assembly, in accordance with the present invention.
Figure 4:
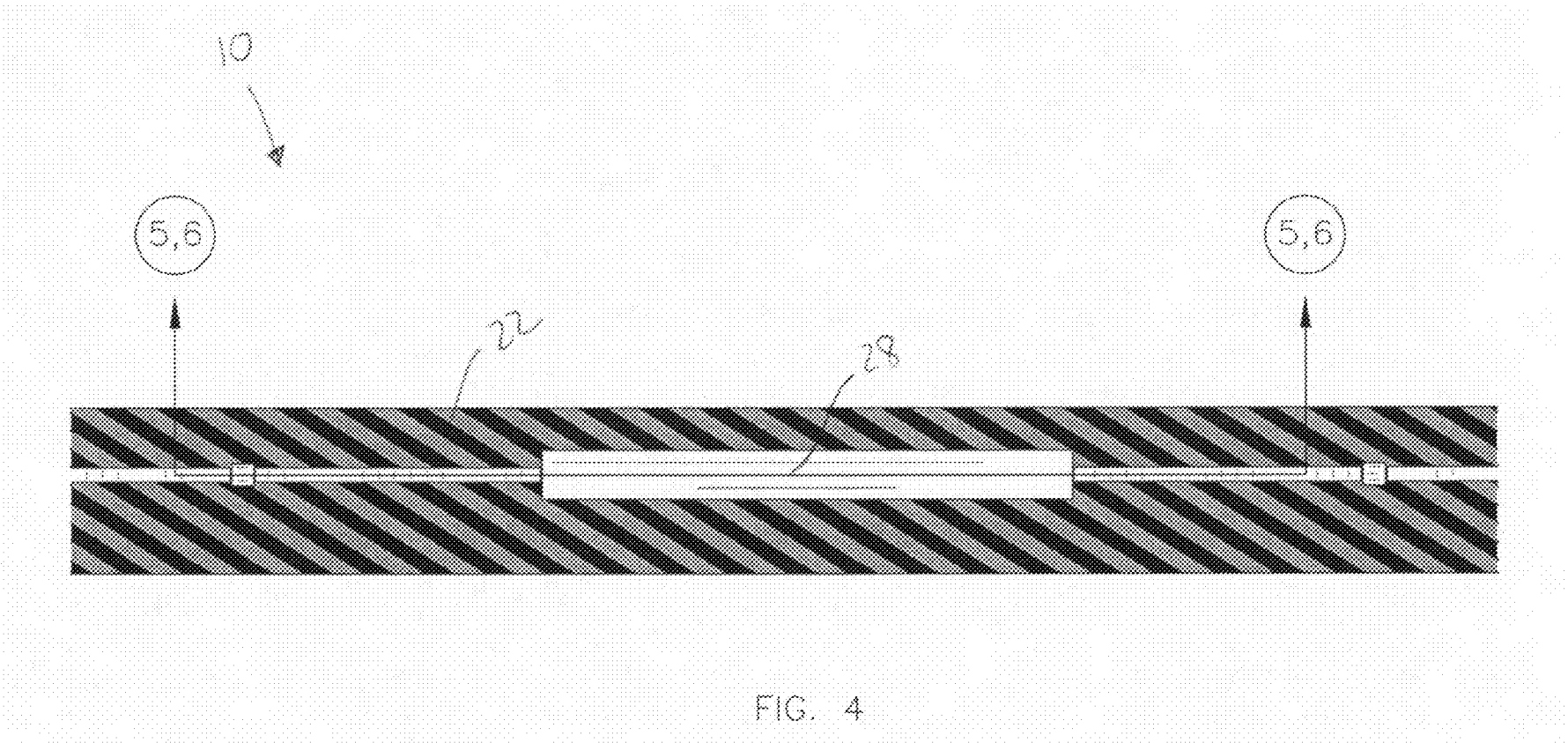
FIG. 4 is a bottom planar view of a combined subway wall and door assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-7 by the reference numeral 10 and is intended to protect a combined subway wall and door assembly. It should be understood that the assembly 10 may be used to protect many different types of platforms and should not be limited in use with only those types of platforms mentioned herein.

Referring initially to FIGS. 1, 2, 3, 4, 5 and 6, a combined wall and door assembly 10 includes a static wall assembly 20 including a segmented support frame 21 with a rectilinear shape. Such a support frame 21 includes a first plurality of horizontally disposed support members 22 situated along segmented end-to-end longitudinal relationships along a ground surface of the subway platform. A plurality of vertically disposed support members 23 are equidistantly spaced between adjacent ones of the first plurality of support members 22 and directly connected, without the use of intervening elements, thereto respectively, and a second plurality of horizontally disposed support members 24 are situated along the segmented end-to-end longitudinal relationship above the ground surface of the subway platform. Such a second plurality of support members 24 are directly connected, without the use of intervening elements, to top ends of the vertically disposed support members 23. The wall assembly 20 extends along the entire platform to prevent passengers from accessing the platform before the subway arrives.

Referring again to FIGS. 1, 2, 3, 4, 5 and 6, the static wall assembly 20 further includes a plurality of transparent fiberglass panels 25 directly coupled, without the use of intervening elements, to the support frame 21 and spaced along an entire longitudinal length of the support frame 21. A plurality of door assemblies 26 includes a plurality of raised access ports 27 statically affixed to selected areas of the support frame 21, and a plurality of horizontally slidable access doors 28 operably engaged with the access ports 27 and positioned generally between the segmented support frame 21. The doors 28 allow access to the platform when the subway arrives.

Figure 7:
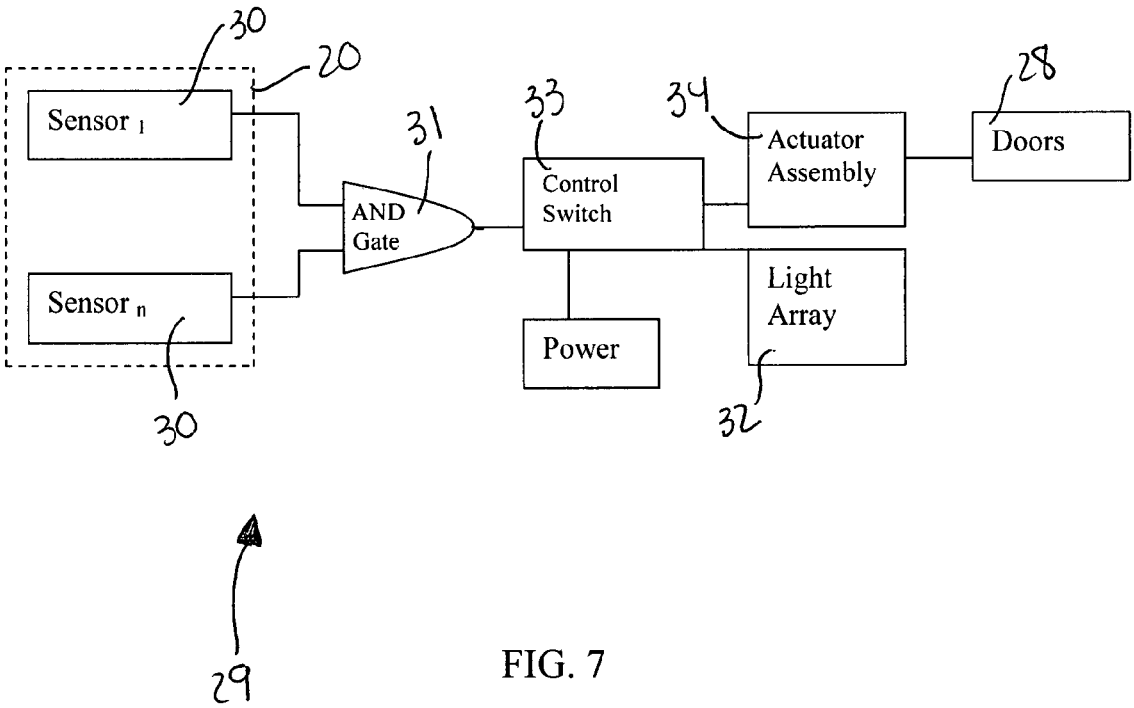
FIG. 7 is a schematic block diagram of an automatic biasing mechanism, in accordance with the present invention.

Referring to FIG. 7, the assembly 10 further includes a mechanism 29 for automatically biasing the access doors between open and closed positions when the subway train arrives and leaves a train terminal respectively which is essential such that passengers are prohibited from premature ingress and egress of the subway train during a schedule stop. Such an automatic biasing mechanism 29 includes a plurality of sensors 30 positioned at selected portions of the wall assembly 20. Each of such sensors 30 generates and transmits an input signal when the subway train reaches the terminal. Each of such input signals has a true value when the access doors 28 are aligned with the subway train, and each of the input signals have a false value when the access doors 28 are not aligned with the subway train.

Referring again to FIG. 7, the automatic biasing mechanism 29 further includes a logic gate 31 directly coupled, without the use of intervening elements, to the sensors 30 and receiving the input signals. Such a logic gate 31 generates and transmits a true output signal when all of the input signals have the true values respectively, and the logic gate 31 generates and transmits a false output signal when at least one of the input signals have a false value. At least one light array 32 is electrically coupled directly, without the use of intervening elements, to the access ports 27.

Referring again to FIG. 7, the automatic biasing mechanism 29 further includes a control switch 33 electrically coupled to the logic gate 31 and responsive to the output signal. Such a control switch 33 generates and transmits first and second control signals for toggling the light-emitting members 32 between first and second colors when the logic gate 31 output signal is true and false respectively. The control signal further generates and transmits a third control signal upon receipt of the true output signal from the logic gate 31. An actuator assembly 34 is operably coupled directly, without the use of intervening elements, to the control switch 33 and the access ports 27 respectively. Such an actuator assembly 34 causes the access doors 28 to slidably adapt between the open and closed positions when the control switch 33 generates and transmits the third control signal. The automatic biasing mechanism 29 opens the access doors 28 when the subway train arrives at the station, and closes the doors 28 when the subway train exits the station.

Figure 5:
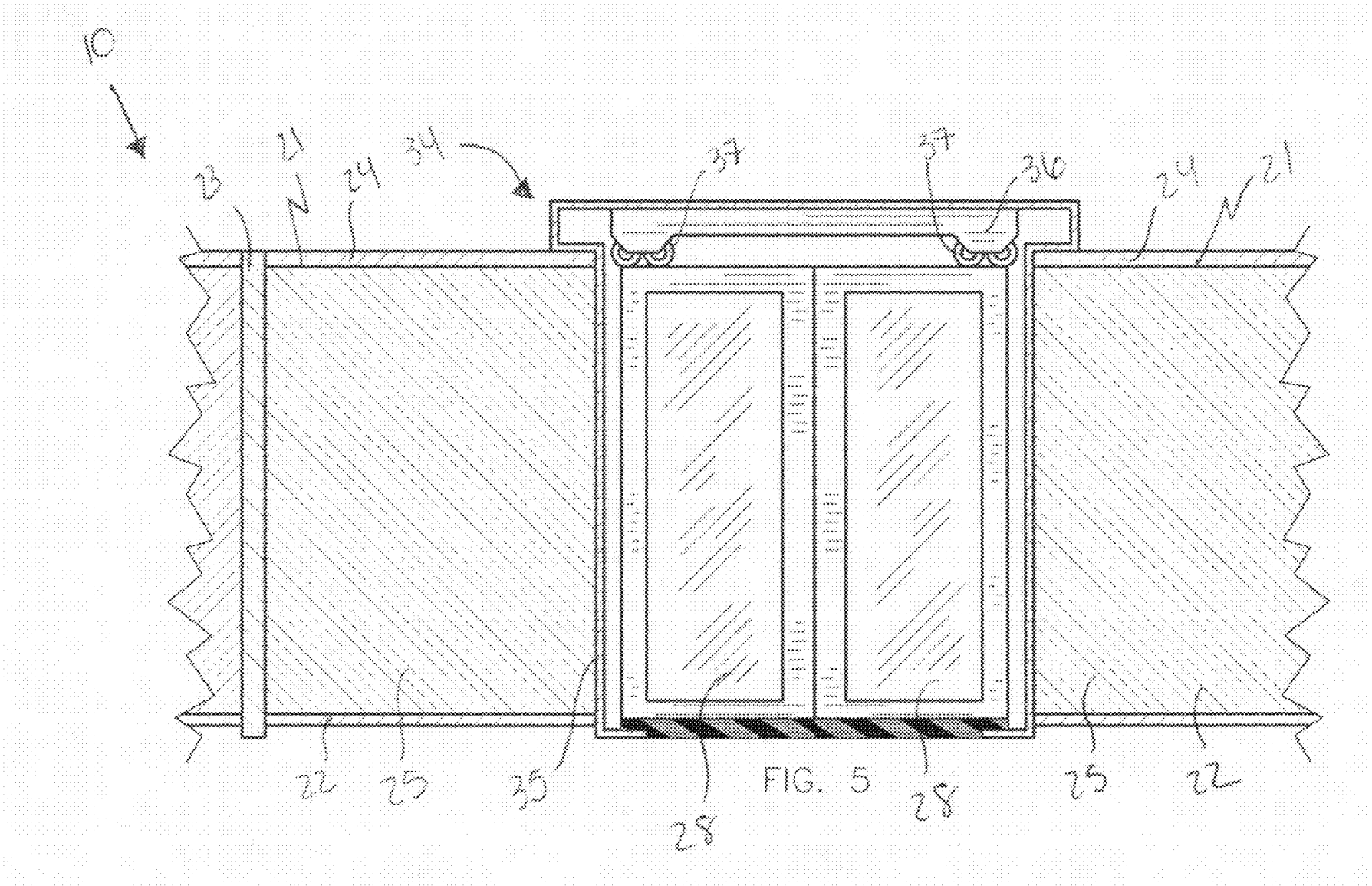
FIG. 5 is a cross sectional view of a combined subway wall and door assembly with the access doors in a closed position, taken along line 5-5, as seen in FIG. 4.
Figure 6:
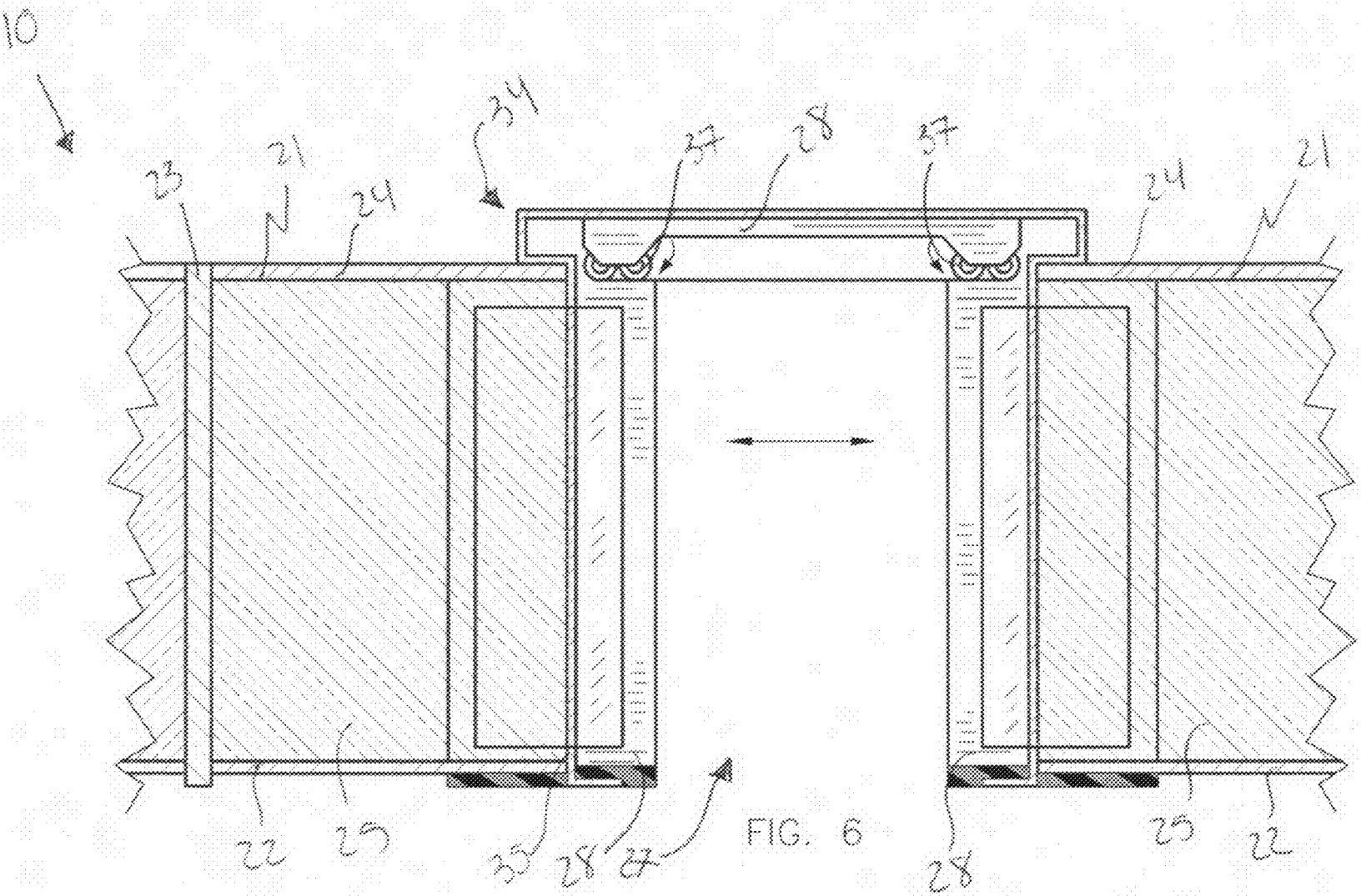
FIG. 6 is a cross sectional view of a combined subway wall and door assembly with the access doors in an opened position, taken along line 6-6, as seen in FIG. 4.

Referring to FIGS. 5 and 6, the actuator assembly 34 includes a single and unitary bracket 35 extending upwardly from the first plurality of support members 22 up to a termination point located above the second plurality of support members 24 respectively. A plurality of guide tracks 36 is directly anchored, without the use of intervening elements, to respective top portions of the brackets 35 and is registered parallel to the first and second pluralities of support members 22, 24 respectively. A plurality of casters 37 is rotatably connected to the guide tracks 36 and extends downwardly therefrom which is vital such that the casters 37 become directly abutted, without the use of intervening elements, against top edges of the access doors 28 respectively. Such casters 37 rotate along clockwise and counter clockwise directions when the control switch 33 transmits the third control signal and thereby cause the access doors 28 to linearly travel along lateral and medial directions within respect to the brackets 35 respectively. The actuator assembly 34 enables the doors to glide open and closed when activated by the automatic biasing mechanism 29.

The support frame 21 remains stationary while the access doors 28 are biased between the open and closed positions, and lateral and medial top corners of the access doors 28 are engaged with the casters 37 when the access doors 28 are situated at the closed and open positions respectively.

The assembly includes a sliding door assembly and retaining walls that are installed on subway loading platforms, which is advantageous to effectively prevent individuals from proceeding beyond the loading platform when it is unsafe to do so. The door panels and wall panels are produced from sturdy fiber glass materials and enclosed within an aluminum alloy frame. Of course, such panels and frame can be produced from a variety of suitable materials, as is obvious to a person of ordinary skill in the art. The sliding doors and retaining walls are solid enough to effectively resist push and prevent passengers from entering the rail area.

A status and warning light assembly are conveniently positioned above the sliding doors, which advantageously allow a passenger waiting on the platform to easily see the warning lights. Of course, such lights can be positioned in any suitable position on the system, as is obvious to a person of ordinary skill in the art. Such lights visually indicate when it is unsafe to pass through the doors and the doors are locked, or when the doors are unlocked and can be safely passed through. The light indicating that the doors are locked is covered by a red lens and the light indicating the doors are unlocked is covered by a green lens. The lights and door locking mechanism are effectively controlled by a sensing assembly that is advantageously activated by an oncoming subway train. The doors remain locked and the red light illuminates until the oncoming train is adjacent to the platform and completely stationary. When the train is stationary and it is safe to board the train, the green light illuminates and the doors unlock. The retaining wall and sliding doors, when installed, effectively extend from the entry wall along the edge of the platform to an area immediately to the rear of the last subway car door.

The present invention, as claimed, provides the unexpected and unpredictable benefit of a system that is convenient and easy to use, is simple to install, and is a practical and much needed safety system that would greatly increase subway safety for anyone that rides subways. The system is simple to operate and easy to understand. Additionally, the system is sturdy and durable, as well as economical and aesthetically pleasing.

In use, a method for utilizing a combined wall and door assembly 10 to provide a safe ingress and egress passageway for a subway train from an adjacent platform includes the steps of: providing a static wall 20 assembly by providing a segmented support frame 21 has a rectilinear shape, and directly coupling, without the use of intervening elements, a plurality of transparent fiberglass panels 25 to the support frame 21 by spacing the fiberglass panels 25 along an entire longitudinal length of the support frame 21; providing a plurality of door assemblies 26 by statically affixing a plurality of raised access ports 27 to selected areas of the support frame 21, and operably engaging a plurality of horizontally slidable access doors 28 with the access ports 27 by positioning the access doors 28 generally between the segmented support frame 21; and automatically biasing the access doors 28 between open and closed positions when the subway train arrives and leaves a train terminal respectively such that passengers are prohibited from premature ingress and egress of the subway train during a schedule stop.

In use, the method further includes the steps of: positioning a plurality of sensors 30 at selected portions of the wall assembly 20; directly coupling, without the use of intervening elements, a logic gate 31 to the sensors 30; electrically coupling at least one light array 32 directly, without the use of intervening elements, to the access ports 27; electrically coupling a control switch 33 to the logic gate 31; operably coupling an actuator assembly 34 directly, without the use of intervening elements, to the control switch 33 and the access ports 27 respectively; each of the sensors 30 generating and transmitting an input signal when the subway train reaches the terminal; each of the input signals has a true value when the access doors 28 are aligned with the subway train; each of the input signals have a false value when the access doors 28 are not aligned with the subway train; the logic gate 31 receiving the input signals and generating and transmitting a true output signal when all of the input signals have the true values respectively; the logic gate 31 generating and transmitting a false output signal when at least one of the input signals have a false value; the control switch 33 is responsive to the output signal and generating and transmitting first and second control signals for toggling the light-emitting members between first and second colors when the logic gate 31 output signal is true and false respectively; the control signal further generating and transmitting a third control signal upon receipt of the true output signal from the logic gate 31; and the actuator assembly 34 causing the access doors 28 to slidably adapt between the open and closed positions when the control switch 33 generates and transmits the third control signal.

In use, the method further includes the steps of: situating a first plurality of horizontally disposed support members 22 along segmented end-to-end longitudinal relationships along a ground surface of the subway platform; equidistantly spacing a plurality of vertically disposed support members 23 between adjacent ones of the first plurality of support members 22 by directly connecting, without the use of intervening elements, the vertically disposed support members 23 thereto respectively; situating a second plurality of horizontally disposed support members 24 along a segmented end-to-end longitudinal relationship above the ground surface of the subway platform; and directly connected, without the use of intervening elements, the second plurality of support members 24 is to top ends of the vertically disposed support members.

In use, the method further includes the steps of: extending a single and unitary bracket 35 upwardly from the first plurality of support members 22 up to a termination point located above the second plurality of support members 24 respectively; directly anchoring, without the use of intervening elements, a plurality of guide tracks 36 to respective top portions of the brackets 35 by registering the guide tracks 36 parallel to the first and second pluralities of support members 22, 24 respectively; rotatably connecting a plurality of casters 37 to the guide tracks 36 by extending the casters 37 downwardly therefrom such that the casters 37 and directly abut, without the use of intervening elements, top edges of the access doors 28 respectively; and the casters 37 rotating along clockwise and counter clockwise directions when the control switch 33 transmits the third control signal and thereby cause the access doors 28 to linearly travel along lateral and medial directions within respect to the brackets 35 respectively.

In use, the method further includes the steps of: maintaining the support frame 21 stationary while the access doors 28 are biased between the open and closed positions; and engaging lateral and medial top corners of the access doors 28 with the casters 37 when the access doors 28 are situated at the closed and open positions respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined wall and door assembly for providing a safe passageway to ingress and egress a subway train from an adjacent platform, said combined wall and door assembly comprising:

a wall assembly including a support frame having a rectilinear shape; and a plurality of transparent fiberglass panels directly coupled to said support frame and spaced along an entire longitudinal length of said support frame;

a plurality of door assemblies including a plurality of raised access ports statically affixed to selected areas of said support frame, and a plurality of horizontally slidable access doors operably engaged with said access ports; and means for automatically biasing said access doors between open and closed positions when the subway train arrives and leaves a train terminal respectively such that passengers are prohibited from premature ingress and egress of the subway train during a schedule stop;

wherein said automatic biasing means comprises:

a plurality of sensors positioned at selected portions of said wall assembly, each of said sensors generating and transmitting an input signal when the subway train reaches the terminal, each of said input signals having a true value when said access doors are aligned with the subway train, each of said input signals have a false value when said access doors are not aligned with the subway train;

a logic gate directly coupled to said sensors and receiving said input signals, said logic gate generating and transmitting a true output signal when all of said input signals have the true values respectively, said logic gate generating and transmitting a false output signal when at least one of said input signals have a false value;

at least one light array electrically coupled directly to said access ports;

a control switch electrically coupled to said logic gate and being responsive to said output signal, said control switch generating and transmitting first and second control signals for toggling said light-emitting members between first and second colors when said logic gate output signal is true and false respectively, said control signal further generating and transmitting a third control signal upon receipt of said true output signal from said logic gate; and an actuator assembly operably coupled directly to said control switch and said access ports respectively, said actuator assembly causing said access doors to slidably adapt between the open and closed positions when said control switch generates and transmits said third control signal;

wherein said support frame comprises:

a first plurality of horizontally disposed support members situated along segmented end-to-end longitudinal relationships along a ground surface of the subway platform;

a plurality of vertically disposed support members equidistantly spaced between adjacent ones of said first plurality of support members and directly connected thereto respectively; and a second plurality of horizontally disposed support members situated along the segmented end-to-end longitudinal relationship above the ground surface of the subway platform, said second plurality of support members being directly connected to top ends of said vertically disposed support members;

wherein said actuator assembly comprises:

a single and unitary bracket extending upwardly from said first plurality of support members up to a termination point located above said second plurality of support members respectively;

a plurality of guide tracks directly anchored to respective top portions of said brackets and being registered parallel to said first and second pluralities of support members respectively; and a plurality of casters rotatably connected to said guide tracks and extending downwardly therefrom such that said casters become directly abutted against top edges of said access doors respectively;

wherein said casters rotate along clockwise and counter clockwise directions when said control switch transmits said third control signal and thereby cause said access doors to linearly travel along lateral and medial directions within respect to said brackets respectively.

2. The combined wall and door assembly of claim 1, wherein said support frame remains stationary while said access doors are biased between the open and closed positions.

3. The combined wall and door assembly of claim 1, wherein lateral and medial top corners of said access doors are engaged with said casters when said access doors are situated at the closed and open positions respectively.

4. A combined wall and door assembly for providing a safe passageway to ingress and egress a subway train from an adjacent platform, said combined wall and door assembly comprising:

a static wall assembly including a segmented support frame having a rectilinear shape; and a plurality of transparent fiberglass panels directly coupled to said support frame and spaced along an entire longitudinal length of said support frame;

a plurality of door assemblies including a plurality of raised access ports statically affixed to selected areas of said support frame, and a plurality of horizontally slidable access doors operably engaged with said access ports and positioned generally between said segmented support frame; and means for automatically biasing said access doors between open and closed positions when the subway train arrives and leaves a train terminal respectively such that passengers are prohibited from premature ingress and egress of the subway train during a schedule stop;

wherein said automatic biasing means comprises:

a plurality of sensors positioned at selected portions of said wall assembly, each of said sensors generating and transmitting an input signal when the subway train reaches the terminal, each of said input signals having a true value when said access doors are aligned with the subway train, each of said input signals have a false value when said access doors are not aligned with the subway train;

a logic gate directly coupled to said sensors and receiving said input signals, said logic gate generating and transmitting a true output signal when all of said input signals have the true values respectively, said logic gate generating and transmitting a false output signal when at least one of said input signals have a false value;

at least one light array electrically coupled directly to said access ports;

a control switch electrically coupled to said logic gate and being responsive to said output signal, said control switch generating and transmitting first and second control signals for toggling said light-emitting members between first and second colors when said logic gate output signal is true and false respectively, said control signal further generating and transmitting a third control signal upon receipt of said true output signal from said logic gate; and an actuator assembly operably coupled directly to said control switch and said access ports respectively, said actuator assembly causing said access doors to slidably adapt between the open and closed positions when said control switch generates and transmits said third control signal;

wherein said support frame comprises:

a first plurality of horizontally disposed support members situated along segmented end-to-end longitudinal relationships along a ground surface of the subway platform;

a plurality of vertically disposed support members equidistantly spaced between adjacent ones of said first plurality of support members and directly connected thereto respectively; and a second plurality of horizontally disposed support members situated along the segmented end-to-end longitudinal relationship above the ground surface of the subway platform, said second plurality of support members being directly connected to top ends of said vertically disposed support members;

wherein said actuator assembly comprises:

a single and unitary bracket extending upwardly from said first plurality of support members up to a termination point located above said second plurality of support members respectively;

a plurality of guide tracks directly anchored to respective top portions of said brackets and being registered parallel to said first and second pluralities of support members respectively; and a plurality of casters rotatably connected to said guide tracks and extending downwardly therefrom such that said casters become directly abutted against top edges of said access doors respectively;

wherein said casters rotate along clockwise and counter clockwise directions when said control switch transmits said third control signal and thereby cause said access doors to linearly travel along lateral and medial directions within respect to said brackets respectively.

5. The combined wall and door assembly of claim 4, wherein said support frame remains stationary while said access doors are biased between the open and closed positions.

6. The combined wall and door assembly of claim 4, wherein lateral and medial top corners of said access doors are engaged with said casters when said access doors are situated at the closed and open positions respectively.

7. A method for utilizing a combined wall and door assembly to provide a safe ingress and egress passageway for a subway train from an adjacent platform, said method comprising the steps of:

a. providing a static wall assembly by providing a segmented support frame having a rectilinear shape, and directly coupling a plurality of transparent fiberglass panels to said support frame by spacing said fiberglass panels along an entire longitudinal length of said support frame;

b. providing a plurality of door assemblies by statically affixing a plurality of raised access ports to selected areas of said support frame, and operably engaging a plurality of horizontally slidable access doors with said access ports by positioning said access doors generally between said segmented support frame; and c. automatically biasing said access doors between open and closed positions when the subway train arrives and leaves a train terminal respectively such that passengers are prohibited from premature ingress and egress of the subway train during a schedule stop;

wherein step c. comprises the steps of:

positioning a plurality of sensors at selected portions of said wall assembly;

directly coupling a logic gate to said sensors;

electrically coupling at least one light array directly to said access ports;

electrically coupling a control switch to said logic gate;

operably coupling an actuator assembly directly to said control switch and said access ports respectively;

each of said sensors generating and transmitting an input signal when the subway train reaches the terminal;

each of said input signals having a true value when said access doors are aligned with the subway train;

each of said input signals have a false value when said access doors are not aligned with the subway train;

said logic gate receiving said input signals and generating and transmitting a true output signal when all of said input signals have the true values respectively;

said logic gate generating and transmitting a false output signal when at least one of said input signals have a false value;

said control switch being responsive to said output signal and generating and transmitting first and second control signals for toggling said light-emitting members between first and second colors when said logic gate output signal is true and false respectively;

said control signal further generating and transmitting a third control signal upon receipt of said true output signal from said logic gate; and said actuator assembly causing said access doors to slidably adapt between the open and closed positions when said control switch generates and transmits said third control signal;

wherein step a. further comprises the steps of:

situating a first plurality of horizontally disposed support members along segmented end-to-end longitudinal relationships along a ground surface of the subway platform;

equidistantly spacing a plurality of vertically disposed support members between adjacent ones of said first plurality of support members by directly connecting said vertically disposed support members thereto respectively;

situating a second plurality of horizontally disposed support members along a segmented end-to-end longitudinal relationship above the ground surface of the subway platform; and directly connected said second plurality of support members being to top ends of said vertically disposed support members;

wherein further comprises the steps of:

extending a single and unitary bracket upwardly from said first plurality of support members up to a termination point located above said second plurality of support members respectively;

directly anchoring a plurality of guide tracks to respective top portions of said brackets by registering said guide tracks parallel to said first and second pluralities of support members respectively;

rotatably connecting a plurality of casters to said guide tracks by extending said casters downwardly therefrom such that said casters and directly abut top edges of said access doors respectively; and said casters rotating along clockwise and counter clockwise directions when said control switch transmits said third control signal and thereby cause said access doors to linearly travel along lateral and medial directions within respect to said brackets respectively.

8. The method of claim 7, further comprising the step of: maintaining said support frame stationary while said access doors are biased between the open and closed positions.

9. The method of claim 7, further comprising the step of: engaging lateral and medial top corners of said access doors with said casters when said access doors are situated at the closed and open positions respectively.

* * * * *